US005683270A

United States Patent [19]

Warislohner

[11] Patent Number: 5,683,270

[45] Date of Patent: Nov. 4, 1997

[54] ELECTRICAL PLUG-TYPE CONNECTOR, PARTICULARLY FOR MEDICAL TECHNOLOGY

[75] Inventor: Josef Warislohner, Kirchseeon-Eglharting, Germany

[73] Assignee: W.W. Fischer SA, Apples, Switzerland

[21] Appl. No.: 386,287

[22] Filed: Feb. 9, 1995

[30] Foreign Application Priority Data

Feb. 10, 1994 [DE] Germany ..... 44 04 260.4

[51] Int. Cl.[6] ..... H01R 9/03

[52] U.S. Cl. ..... 439/610; 439/606

[58] Field of Search ..... 439/607–610, 439/95, 98, 101, 105, 108, 606

[56] References Cited

U.S. PATENT DOCUMENTS

| | | | |
|---|---|---|---|
| 4,891,022 | 1/1990 | Chandler et al. | 439/610 |
| 4,921,441 | 5/1990 | Sauder | 439/610 |
| 4,974,075 | 11/1990 | Nakajima | 439/610 |
| 5,108,294 | 4/1992 | Marsh et al. | 439/607 |
| 5,180,316 | 1/1993 | Miller et al. | 439/610 |

OTHER PUBLICATIONS

Hauptkatalog, 2nd Edition of W.W. Fischer SA, Switzerland.

*Primary Examiner*—Hien Vu

*Attorney, Agent, or Firm*—Hill, Steadman & Simpson

[57] ABSTRACT

In an electrical plug-type connector composed of a socket and a plug part, A sleeve-shaped metal shielding is embedded in the socket or, respectively, a plug housing of insulating material insulated toward the inside and toward the outside and lies exposed only in a plug zone.

20 Claims, 1 Drawing Sheet

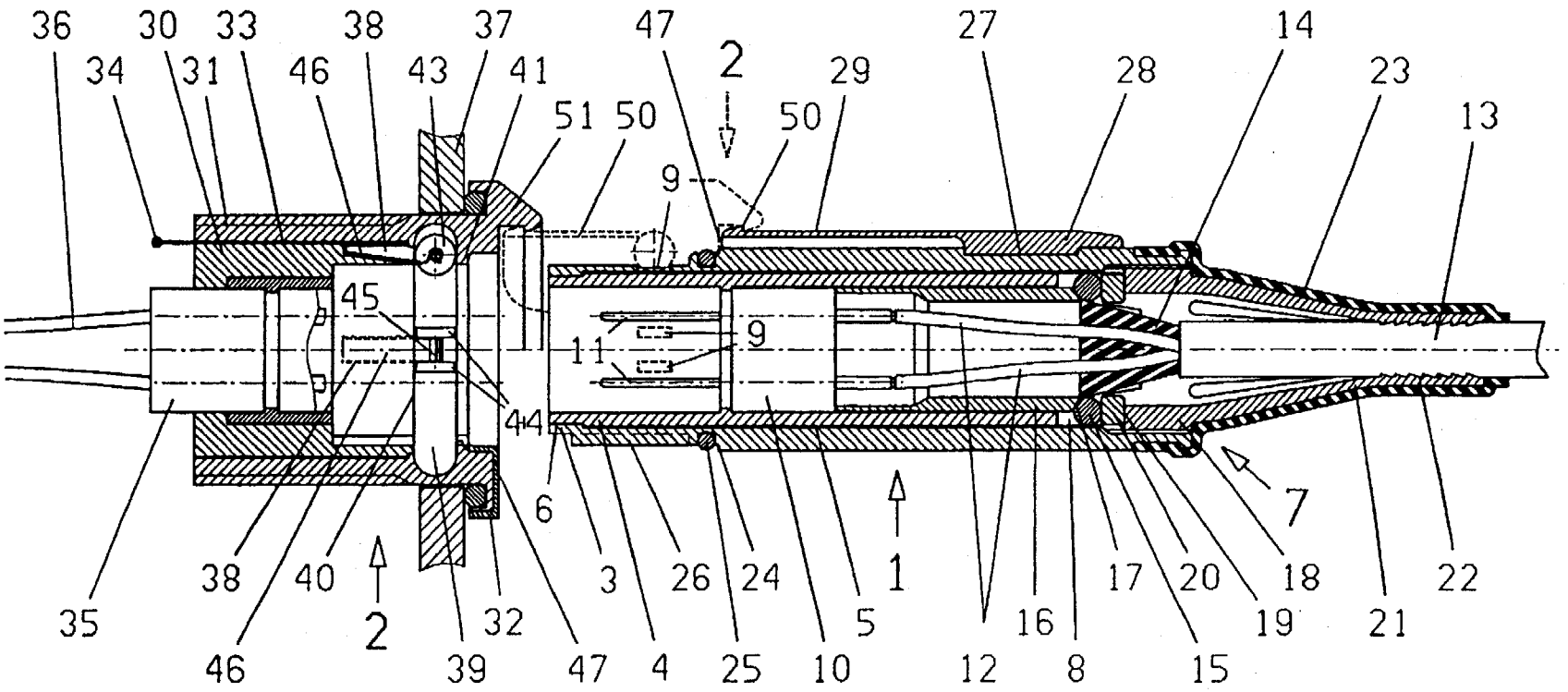
13
23
14
28
27
29
50
2
47
9
50
51
41
37
43
38
46
33
31
30
34
36
22
21
7
18
19
20
15
17
8
16
12
1
5
10
24
25
26
4
3
6
47
32
39
2
40
46
38
35
9
11
44
45

ELECTRICAL PLUG-TYPE CONNECTOR, PARTICULARLY FOR MEDICAL TECHNOLOGY

BACKGROUND OF THE INVENTION

The present invention is directed to an electrical plug-type connector, preferably for medical technology, composed of a plug part and a socket.

Many embodiments of plug-type connectors of this species are known (see, for example, the circular connector of the Hauptkataloq, 2nd Edition of W. W. Fischer SA, Switzerland. The housing of the plug part that accepts the contact insert and, usually, the housing of the socket accepting the appertaining contact insert are composed of metal and thus simultaneously serve as electrical shielding in that they are electrically connected to the shielding fabric of the connected cable. It is also known to manufacture the housing of such a plug part or, respectively, of such a socket of high-grade plastic material. When an electrical shielding is also desired here, it is known to plug a metal sleeve into this plug housing of insulating material, this metal sleeve being in turn electrically connected to the shielding of the cord and the metal inside thereof lying exposed in the inside of the plug.

These known plugs do not meet the high demands regarding protection against accidental contact as have been made in the interim, particularly for medical technology in the international standard IEC 602 or, respectively, VCE 750. What is required according to this standard is that electrostatic charges should in no case be transmitted via the metal shielding of the plug onto the contacts or, respectively, contact locations of the cords at the contact insert. If a known plug were used, for example, in invasive surgery for the connection of devices to the endoscope, then there would be the risk that an electrostatic charge would be transmitted via the attending person onto the metal shielding of the plug, this electrostatic charge proceeding inside the plug onto the lines leading to the endoscope via air gaps and leakage paths and, thus, directly into the body of the patient.

SUMMARY OF THE INVENTION

It is an object of the present invention to provide an electrical plug-type connector, particularly for medical technology, that avoids this disadvantage and wherein the transmission of external voltages such as electrostatic charges via the metal shielding onto the contacts of the plug-type connector is avoided.

In general terms one embodiment of the present invention is a plug part pluggable into a socket of an electrical plug-type connector, particularly for medical technology. A housing of insulating material accepts a contact insert and a sleeve-shaped metal shielding extending from a plug zone up to a cable connection end. The metal shielding is embedded in the insulating material of the housing and is thus insulated inside and outside. The metal shielding is exposed toward the outside only in the plug zone in at least one window-shaped clearance of the outer insulating material and is inwardly exposed only in a region of the cable connection end as an annular surface for the connection of a cable shielding of a cable.

The housing is composed of two sleeves of insulating material plugged into one another. The metal shielding is inserted between these sleeves. The outer sleeve has at least one window-shaped clearance in the plug zone. The inner sleeve is selected axially shorter than the metal shielding and the outer sleeve surrounding the latter.

A plurality of window-shaped clearances distributed in predetermined angular spacings are provided at the circumference of the outer insulating material that surrounds the metal shielding.

The metal shielding lies exposed in the plug zone in an annular gap of the outer insulating material.

The shielding of the cable connected to the plug part is pressed via an expandable thrust collar onto the inwardly exposed annular surface of the metal shielding. A pressure member that surrounds the cable can be screwed to the cable connection end of the housing, the pressure member collaborating with the thrust collar such that, when the pressure member is screwed in, the latter is pressed radially outward via a conical end face provided in the housing onto the exposed annular surface of the metal shielding. The conical end face is fashioned at the end of a spacer sleeve arranged in the housing between contact insert and thrust collar.

In general terms another embodiment of the present invention is a plug part of an electrical plug-type connector having a cable strain relief attached to the cable introduction end of the plug housing, particularly for a plug part as described above. The cable strain relief has a multiply slotted sleeve put in place on the cable, and the ends of the sleeve fingers formed by the slots have an inside toothing that can be impressed into the cable cladding. A coating that holds the inside toothing in the impressed condition is applied on the slotted sleeve. This coating is a sleeve-like part composed of a material that shrinks when heated.

In general terms another embodiment of the present invention is a socket for the acceptance of a plug part of an electrical plug-type connector, particularly of a plug part as described above. At least that part of the socket housing that accepts the contact insert and forms the plug zone is composed of insulating material. A sleeve-shaped metal shielding is put in place on the outside at this insulating material part. At least one radially inwardly salient shield contact that is electrically connected to the metal shielding is provided only in the plug zone.

A plurality of shield contacts distributed in predetermined angular spacings are provided at the inside circumference of the insulating material part. The shield contacts are axially inwardly salient through at least one window-shaped clearance in the insulating material part.

The shield contacts are fashioned as rollers that are radially inwardly pre-stressed by contact springs that are electrically connected to the metal shielding. The rollers are fashioned as double rollers having a conical outside circumference matched to the inside circumference of the plug zone.

Chambers for the acceptance of the shield contacts are fashioned uniformly distributed over the circumference at the outside circumference of the insulator material part.

The outer part of the housing surrounding the metal shielding is also composed of insulating material and the metal shielding is embedded between these insulating material parts insulated on all sides.

The outer part of the housing surrounding the metal shielding is composed of metal. The outer end face of the metal part is coated with insulating material.

The socket is fashioned as a cable coupling and the metal shielding lies exposed toward the inside in the region of the cable connection end as an annular surface for the connection of the cable shielding.

In general terms yet another embodiment of the present invention is an electrical plug-type connector composed of a plug part as described above and of a socket as described above. The window-shaped clearances of the outer insulator material of the plug part and the shield contacts of the socket are arranged such that, in the plugged condition, the shield contacts of the socket engage into the clearances of the plug part and contact the metal shielding lying exposed therein. A seal ring that presses against the socket housing impermeable to water under pressure in the plugged condition is provided at the outside circumference of the plug zone of the plug part. A releasable interlock is provided between plug part and socket. The interlock is composed of at least one resiliently yielding finger that can be put in place on the plug part and has a hook end section and of at least one hook part that is fashioned at the socket housing and can be interlocked with the hook section of the finger. At least the outwardly accessible insulating material parts of the plug part and/or of the socket are composed of a plastic material that can be sterilized by steam or irradiation.

In a plug-type connector of the present invention, it is assured both in the plug part as well as in the socket that, first, the metal shielding is fully insulated against external contacting on all sides. In the plug part, the shielding sleeve that is also insulated at the inside can only be touched via small windows at the outside circumference of the outer insulation with the plug-type connector when unplugged. In the plugged condition, contact from the outside is no longer possible at all. As a result of the complete insulation of the metallic shielding sleeve even toward the inside, a distance between the exposed sections of this metal sleeve and the contact pins or, respectively, the contact locations of the stranded cable conductors at the contact inserts that can be selected arbitrarily large dependent on the type of plug is present. Thus a transmission of electrostatic charges for the metal shielding of the plug via air gaps or leakage paths to the lines of the plug is reliably prevented. A plug-type connector of the present invention is also employable for the first time for medical technology with the aforementioned strict demands of safety margins between outer shielding and inner contacts. In addition to the electrical contacts, the plug-type connector of the present invention can also be used for contacting light waveguides or for simultaneously producing mechanical connections such as liquid hoses or the like. It is thus universally suitable for operations of medical technology, particularly when the individual plastic parts of the plug-type connector are composed of a material that can be sterilized with steam or irradiation.

BRIEF DESCRIPTION OF THE DRAWING

The features of the present invention which are believed to be novel, are set forth with particularity in the appended claims. The invention, together with further objects and advantages, may best be understood by reference to the following description taken in conjunction with the accompanying drawings, in the several Figures of which like reference numerals identify like elements, and in which:

The single FIGURE depicts in longitudinal section and greatly enlarged scale, an electrical plug-type connector of the present invention composed of a concentric plug part and an appertaining concentric socket.

DESCRIPTION OF THE PREFERRED EMBODIMENT

The plug part 1 is composed of a housing of plastic, for example PEEK (PolyEther Ether Ketone) that is extremely temperature resistant and shape stable and which is also not attacked by sterilization. The housing is composed of two plastic sleeves 3 and 4 plugged into one another and between which a sleeve 5 of metal is embedded. The two plastic sleeves 3, 4 lie directly against one another in the front plug region 6 and are bonded or glued to one another thereat by ultrasound as warranted. The metal sleeve 5 extends from this plug region 6 up to the cable connection end 7. The inner plastic sleeve 4 is fashioned shorter than the outer plastic sleeve 3 and the metal sleeve 5, so that the latter lies uncovered toward the inside in an annular region 8 close to the cable connection end. Windows 9 uniformly distributed over the circumference are fashioned at the outer circumference of the outer plastic sleeve 3 in the plug region of the plug part 1 that is fully plugged into the socket 2 in the plugged condition, the metal sleeve 5 lying uncovered toward the outside in these windows 9. Instead of a plurality of individual windows distributed over the circumference, a corresponding, continuous annular gap could also be provided as warranted in the outer plastic sleeve 3, so that the metal sleeve 5 is uncovered in a continuous annular gap. The contact insert 10 is inserted insulated in the inside of the inner plastic sleeve 4, the plug pins 11 of this contact insert 10 being soldered or crimped at the back end to the leads 12 of the cable 13.

The length of the inner plastic sleeve 4 in the direction of the cable connection end 7 is selected of such a size that the distance between the exposed annular zone 8 of the metal sleeve 5 and the contact locations of the lines 12 at the plug pins 11 corresponds to the safety margin required according to the aforementioned standard.

The metallic shielding fabric 14 of the cable arranged under an outer insulating layer is placed around an opened thrust collar 15 that is put in place on the cable. This thrust collar together with the shielding fabric 14 placed around its circumference is arranged in the annular region 8 wherein the metal sleeve 5 is exposed toward the inside. A spacer sleeve 16 having a conical end face 17 is also arranged between this thrust collar 15 and the contact insert 10. A pressure member 18 is screwed in at the back end of the outer plastic sleeve 4, this pressure member 18 pressing on the thrust collar 15 via an intermediate ring 20 when screwed in. As a result of this axial pressure, the thrust collar 15 is radially widened via the conical surface 17 of the spacer sleeve 16 and the metal fabric 14 of the cable pulled over this thrust collar 15 is thus pressed against the exposed annular surface 8 of the metal sleeve 5 with good electrical contact. That end 21 of the pressure member 18 facing away from the threaded section is multiply slotted and a respective inside toothing 22 is fashioned at the ends of the sleeve arms formed by these slots, this inside toothing 22 being pressed into the outer insulating cladding of the cable 13 due to radial pressure onto the sleeve fingers. Subsequently, a shrink hose 23 or a correspondingly prefabricated, thermoplastically deformable formed part having shrink properties is then also subsequently placed over the slotted pressure member 18, this assuring that the inside toothing impressed into the cable cladding no longer releases after having been impressed, i.e. that the cable remains secured against being pulled out. A coil spring that is placed onto the fingers 21 would, for example, also suffice for securing.

This inventive type of cable strain relief can also be employed given plug parts whose housings are composed of metal in a known way. It is not limited to employment given a plug part that comprises a shielding sleeve 5 of metal insulated on all sides in the sense of the above description.

The appertaining socket 2 is similarly constructed. It is composed of an inner, pot-shaped plastic part 30 and of an outer pot part 31 fitting thereon that is either again composed of plastic or that can also be composed of metal under certain circumstances. In the latter instance, the socket flange of this part 31 that is exposed toward the outside is covered with an insulating material 32. A metal sleeve 33 again serving as shielding is inserted between these two parts 30 and 31 plugged into one another, the back end of this metal sleeve 33 being provided, for example, with a terminal lug 34. The contact insert 35 is inserted in the inside of the part 30 composed of plastic, the contact jacks of this contact insert 35 being connected to the leads 36 conducted out at the back. The socket housing 30, 31 is secured to a schematically indicated front panel 37 of a device via a nut (not shown) that is screwed onto the part 31 at the outside. Axial chambers 38 are fashioned at the outside circumference of the plastic part 30, these axial chambers 38 discharging into an annular space 39 that is limited by the outer edge 40 of the plastic part 30 and the correspondingly inwardly drawn edge 41 of the outer part 31 arranged thereover. Double contact rollers 43 are arranged in this annular space 39 uniformly distributed at the circumference, the plurality and arrangement of these contact rollers 43 composed of metal at the circumference of the plastic part 30 being selected corresponding to the arrangement and distribution of the windows 9 of the plug part 1. Each double contact roller 43 is composed of two conical roller sections 44 that are connected to one another by a shaft part 45. The end of a spring 46 is snapped in at this shaft part 45, the stirrup section of said spring bent back U-shaped being inserted in the chamber 38 and the stirrup end thereof pressing with good electrical contact against the inside wall of the metal sleeve 33 lying exposed in this chamber 38. The spring end can be potentially additionally soldered or welded to the sleeve 33 in this region. The double rollers 43 are pressed radially inward by the spring 46.

In the socket, too, the inner plastic part 30 is again dimensioned such that, in the plugged condition, the metal sleeve 33 and the contact rollers 43 have an adequate safety margin from the contacts and lead wires as required by the standard.

When the plug part 1 is plugged into the socket 2, the double rollers 43 are pressed radially outward by the outer plastic sleeve 3. As a result of the conical fashioning of the circumferential surfaces of the roller sections 44, they are pressed planarly against the outside surface of the plastic part 3 and the surface of the plug section is not damaged by sharp roller edges. The plug part 1 is plugged in until the detente of the edge 24 of the plug region of the plug part 1 is against the end face 47 of the socket housing, as indicated with broken lines at the plug part. In this position, the conical roller sections 44 of the double contact rollers 43 snap into the windows 9 fashioned as double windows in the outer plastic sleeve 3 and thus make electrical contact with the metal sleeve 5 exposed therein. A seal ring 25 can be inserted in a channel at the end 24 of the plug region, this seal ring 25 sealing the plug part and socket in the plugged condition.

The socket 2 can be implemented not only as a surface mounted part but can also be implemented in the same way as a plug coupling. In this case, the back part of the socket 2 shown in the single FIGURE is constructed similar to the cable connector part 7 of the plug part 1, i.e. the plastic part 30 is lengthened toward the back and corresponds to the inner plastic part 4, the plastic part 31—in the back part—corresponds to the plastic part 5, the metal sleeve 3 lies exposed in an annular gap, and the shielding fabric of the cable connected to the coupling is electrically connected to the shielding sleeve via a corresponding thrust collar, as in the case of the plug part 1.

The slotted embodiment of the pressure member 18 in the region of the cable bushing assures that cables different thicknesses can also be secured in one and the same pressure member secured against being pulled out. The shrink part 23 that is also subsequently applied can also be thermoplastically glued to the pressure member and to the cable as warranted, so that the plug-type connector is also impermeable to water at this location. In the illustrated exemplary embodiment, the housing of plug part 1 and socket 2 is assembled with two sleeve-like parts 3, 4 or, respectively, 30, 31 plugged inside one another. Another possibility is in manufacturing the housing AS one piece with the metal sleeve 5 or, respectively, 31 embedded therein in insulated fashion as an injected molded part. Since the shielding sleeve 5 or, respectively, 31 given the plug-type connector of the present invention has no mechanical function and the shape stability of the plug housing is assured solely by the plastic parts, the shielding sleeve can also be applied onto the plastic parts only as a metallic deposition as warranted or can be composed only of an inserted thin foil. Simple wiper contacts could also be provided instead of the contact rollers 43, this being advantageous particularly when the exposed zone of the metal shielding 5 at the plug part is fashioned as a continuous annular zone. In this case, a nearly closed contacting of the sleeve circumference can then be produced. Instead of the continuous annular space 39 at the socket 2 for the acceptance of the contact rollers 43, individual depressions distributed at the circumference could also instead be provided for the acceptance of the rollers 43. The correct plug-in position between plug part 1 and socket 2 is assured in a known way by one or more ribs 26 fashioned at the circumference of the plug zone and angularly offset relative to the rollers 43, these ribs 26 fitting into corresponding grooves of the socket. The principle of the present invention, of course, is not only suitable for circular connectors but is also suitable for plugs and sockets having an polygonal cross sectional configuration.

In order to avoid unintentional pulling of the plug part 1 from the socket 2, it is advantageous to provide a releasable interlock between plug part 1 and socket 2 such as, for example, the known plugs according to the afore-mentioned *Hauptkataloq* of the Fischer Company. Another possibility is shown in the single FIGURE. A retainer ring 28 is put in place at the outside circumference of the plug part 1 over an annular channel 27 fashioned in the outer plastic sleeve 3, a finger 29 profiled semi-circularly in cross section and projecting in the direction of the plug end projecting from said retainer ring 28 and ending in a hook-like, radial projection 50. A corresponding, hook-like, radially inwardly projecting projection 51 is provided at the edge of the end face 47 of the socket housing 31. In the introduced condition, the end 50 hooks behind the hook-like projection 51, as indicated with broken lines in the single figure, in that the resiliently yielding finger 29 is pressed radially inward over the hook end 51 during plugging until it snaps in behind the hook 51. For releasing this interlock, the finger 29 is pressed radially inward and the interlocking is thus released. The plug part 1 can then be pulled axially outward unimpeded. As warranted, a corresponding interlock 50, 51 can also be provided at the radially opposite side. This interlock can be released from the plug part at any time via the retainer section 28 and can be put in place only when needed.

The additionally placed retainer ring 28 having a finger 29 projecting axially therefrom is also suitable for another purpose, namely for subsequently attaching plug markings to the plug housing, for example in the form of a colored marking. In this case, the semicircularly profile finger 29 is fashioned without a projection 50. It does not reach the socket in the plugged condition. For example, a color marking that coincides with a corresponding color marking of the appertaining socket is applied on its surface. The plug parts can thus be subsequently correspondingly identified by putting correspondingly color-coded retainer rings in place thereon.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. An electrical plug part for plugging into an electrical socket of an electrical plug-type connector, comprising:

a housing of insulating material that receives a housing contact insert and a sleeve-shaped metal shielding extending from a plug zone of the plug part to a cable connection end of the plug part; and the metal shielding being embedded between an inner insulating material part and an outer insulating material part of the housing and being completely insulated at an inside and an outside of the metal shielding the inner and outer insulating parts of the housing being inner and outer sleeves respectively, of insulating material plugged into one another, the metal shielding being located between said inner and outer sleeves, the outer sleeve having at least one window-shaped clearance in the plug zone, the inner sleeve being axially shorter than the metal shielding and the outer sleeve surrounding the metal shielding, wherein a shield portion of the metal shielding is exposed in the plug zone in an annular gap of the outer insulating material part.

2. The plug part according to claim 1, wherein a plurality of window-shaped clearances, distributed with predetermined angular spacings, are provided at a circumference of the outer insulating material part that surrounds the metal shielding.

3. The plug part according to claim 1, wherein the cable shielding of the cable connected to the plug part is pressed via an expandable thrust collar onto the inwardly exposed annular surface of the metal shielding.

4. The plug part according to claim 3, wherein a pressure member, adjacent the thrust collar, that surrounds the cable is screwed to the cable connection end of the housing, said pressure member collaborating with the thrust collar that, when the pressure member is screwed in, the thrust collar is pressed radially outward via a conical end face provided in the housing onto the exposed annular surface of the metal shielding.

5. The plug part according to claim 4, wherein the conical end face is at the end of a spacer sleeve arranged in the housing between contact insert and thrust collar.

6. The plug part according to claim 1, wherein the plug part has a cable strain relief attached to a cable end of the plug housing, wherein the cable strain relief has a sleeve having a plurality of slots on the cable, ends of sleeve fingers formed by said slots engaging cable cladding of the cable.

7. The plug part according to claim 6, wherein each of the slots of the sleeve has a coating.

8. The plug part according to claim 7, wherein said coating is a heated material that shrinks when heated.

9. An electrical socket for receiving an electrical plug part of an electrical plug-type connector, the plug part having a first housing contact insert, the socket comprising:

an insulated socket housing a back portion, that receives a second housing contact insert and a front portion that forms a plug zone for receiving the plug part;

a sleeve-shaped metal shielding on an outside of said back portion; and at least one radially inwardly salient shielding contact that is electrically connected to the metal shielding, said at least one radially inwardly shielding contact being provided only in the plug zone and extending partially into said socket housing, said shielding contact engaging a spring member that connects to the metal shielding.

10. The socket according to claim 9, wherein a plurality of shielding contacts, distributed in predetermined angular spacings, are provided at an inside circumference of the plug zone of the insulating socket housing.

11. The socket according to claim 9, wherein the shielding contacts are rollers that are radially inwardly pre-stressed by contact springs that are electrically connected to the metal shielding.

12. The socket according to claim 11 wherein the rollers are double rollers having a conical configuration that fits into an inside circumference of the plug zone.

13. The socket according to claim 9, wherein chambers for acceptance of the shielding contacts are uniformly distributed over a circumference at an outside circumference of the insulated socket housing.

14. The socket according to claim 9, wherein the socket housing also has an insulated outer part surrounding the metal shielding, the metal shielding being embedded between the outer part and the at least a part of the socket housing.

15. The socket according to claim 9, wherein the socket housing has an outer part that surrounds the metal shielding, the outer part being composed of metal.

16. The socket according to claim 15, wherein an outer end face of the outer part is coated with insulated material.

17. An electrical plug-type connector, comprising:

a plug part having a housing of insulating material that receives a first housing contact insert and a sleeve-shaped metal shielding extending from a plug zone of the plug part to a cable connection end of the plug part;

the metal shielding embedded between inner and outer insulating parts of the housing and being insulated at an inside and an outside of the metal shielding the inner and outer insulating parts of the housing being inner and outer sleeves, respectively, of insulating material plugged into one another, the metal shielding being located between said inner and outer sleeves, the outer sleeve having at least one window-shaped clearance for exposing a shield portion of the metal shielding in the plug zone, the inner sleeve being axially shorter than the metal shielding and the outer sleeve surrounding the metal shielding, a socket having socket housing having a back portion, that receives a second housing contact insert and forms a plug zone at a front portion thereof, the back portion being composed of insulating material;

the socket having a sleeve-shaped metal shielding on an outside of said back portion;

the socket having at least one radially inwardly salient shielding contact that is electrically connected to the metal shielding and that is provided only in the plug zone; and the at least one window-shaped clearance of the outer sleeve of the plug part and the at least one radially inwardly salient shielding contact of the socket being arranged such that, in a plugged condition, the shielding contact of the socket engages the at least one window-shaped clearance of the plug part and contacts the exposed shielding portion of the metal shielding.

18. The plug-type connector according to claim 17, wherein a seal ring that presses against the socket housing, impermeable to water under pressure in the plugged condition, is provided at the outside circumference of the plug zone of the plug part when the plug part being inserted into the socket housing.

19. The plug-type connector according to claim 17, wherein a releasable interlock is provided between plug part and socket.

20. The plug-type connector according to claim 19, wherein the interlock is composed of at least one resiliently yielding finger on the plug part, the yielding finger having a hook end section, and of at least one hook part at the socket housing that interlocks with the hook section of the finger in a plugged condition of the plug-type connector.

* * * * *